United States Patent [19]

SoRelle

[11] 4,306,392

[45] Dec. 22, 1981

[54] DOME STRUCTURE

[76] Inventor: Frankie O. SoRelle, 307 W. Ave. A, Sweetwater, Tex. 79556

[21] Appl. No.: 136,713

[22] Filed: Apr. 2, 1980

[51] Int. Cl.[3] ..... E04B 1/32

[52] U.S. Cl. ..... 52/81; 52/86

[58] Field of Search ..... 52/80, 81, 86, DIG. 10

[56] References Cited

U.S. PATENT DOCUMENTS

| | | | |
|---|---|---|---|
| 3,043,054 | 7/1962 | Schmidt | 52/81 |
| 3,646,718 | 3/1972 | McKenna | 52/81 |
| 3,854,255 | 12/1974 | Baker | 52/81 |
| 3,881,284 | 5/1975 | Martin | 52/81 |
| 3,925,940 | 12/1975 | O'Connell | 52/81 |
| 4,075,813 | 2/1978 | Nalick | 52/81 |
| 4,160,345 | 7/1979 | Nalick | 52/81 |

*Primary Examiner*—Price C. Faw, Jr.
*Assistant Examiner*—Henry E. Raduazo
*Attorney, Agent, or Firm*—Harvey B. Jacobson

[57] ABSTRACT

A number of polygonal panels each provided with a peripheral edge flange integral therewith being secured together in edge-to-edge relationship to form a dome structure which may be generally pyramidal, triangular or square in plan configuration. The panels may be constructed of glass fiber, reinforced plastic material, or may be constructed with a suitable rigid frame and covering skin with the frame and skin being constructed of various materials. The panels may be secured together in any suitable conventional manner depending upon the material from which the panels are constructed.

3 Claims, 33 Drawing Figures

FIG. 1
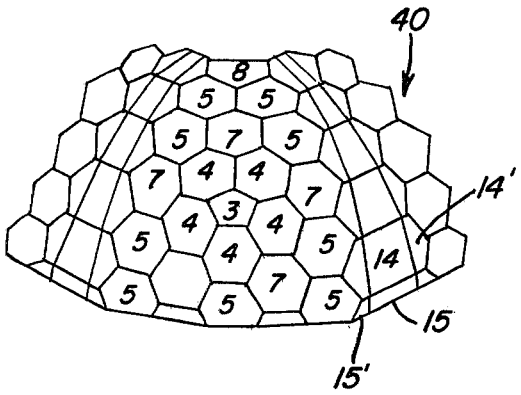
FIG. 2
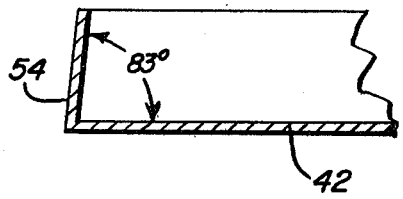
FIG. 3
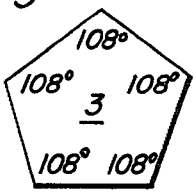
FIG. 4
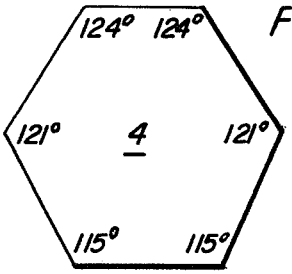
FIG. 5
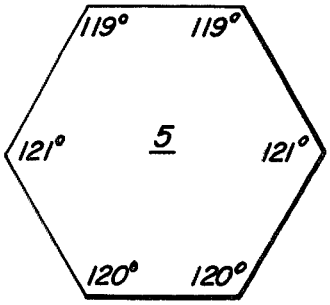
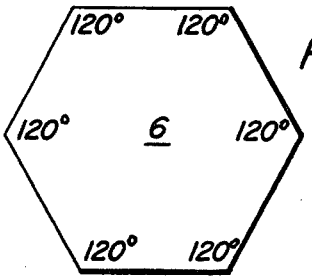
FIG. 6
FIG. 7
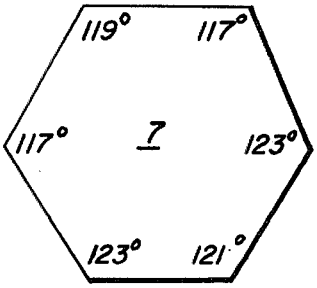
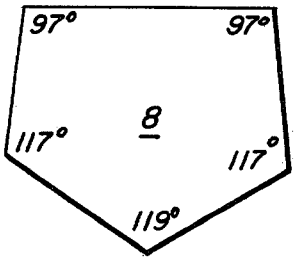
FIG. 8
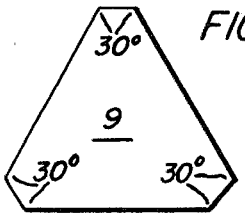
FIG. 9

FIG. 16
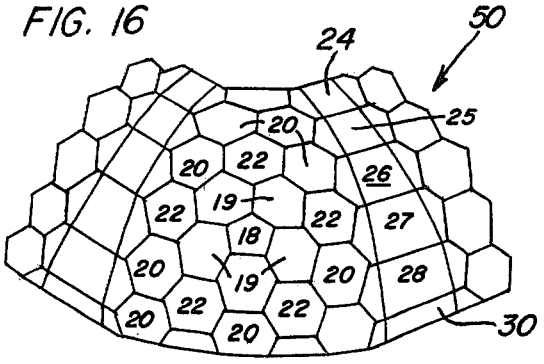
FIG. 17
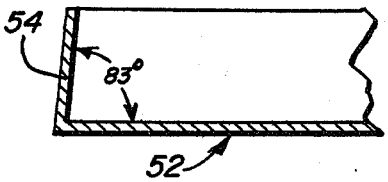
FIG. 19
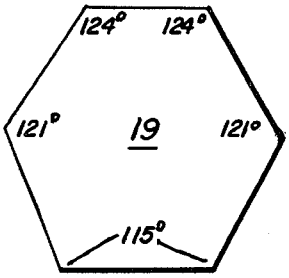
FIG. 18
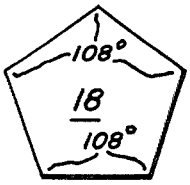
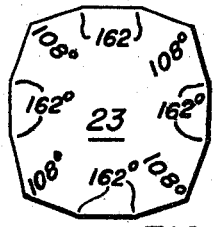
FIG. 23
FIG. 21
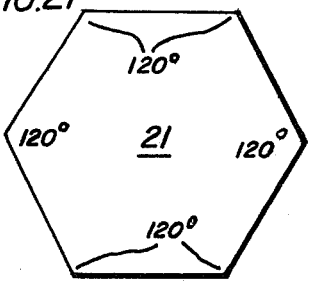
FIG. 20
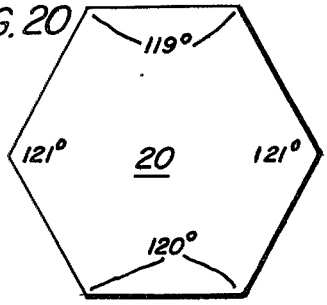
FIG. 33
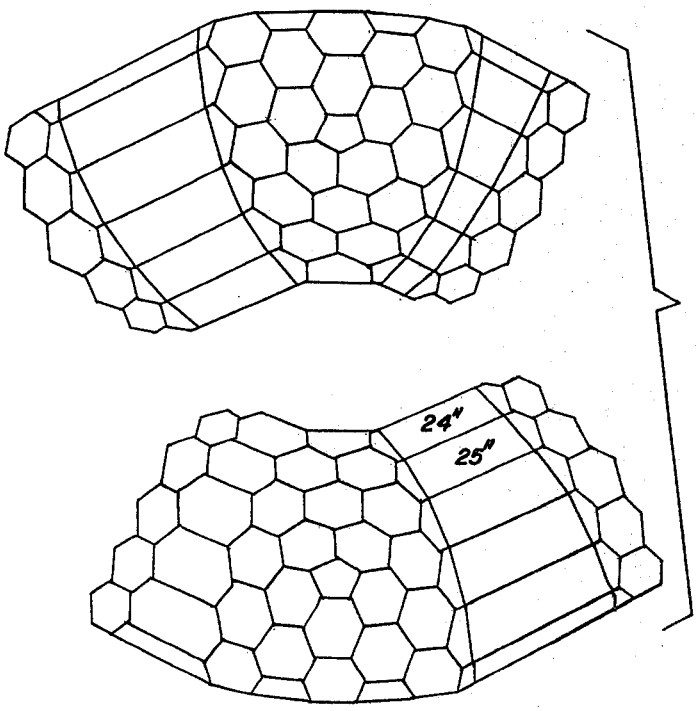
FIG. 22
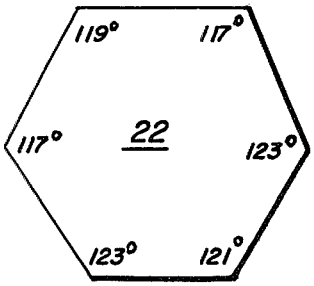

31
124
90
31
121
24'
115
100°
95°
24
95°
80°

54
83°
85½°
52
24'

120
121
25'
90
119
100°
90°
25
90°
80°

108
162
108
162

120
26'
90
120
100°
87°
26
87°
80°
119
121
27'
90
120
98½°

85°
27
86°
81½°
120
121
28'
90
85½°
119
94½°

28
85½°
85½°
120
29'
90
85½°
120
91½°

29
85½
88½°
120
30'
90
83°
85½°
89½°
30

85½°
90½°
90°

DOME STRUCTURE

BACKGROUND OF THE INVENTION

1. Field of the Invention

The present invention generally relates to domed structures and more specifically such structures assembled by utilizing a plurality of panels oriented in modular arrangements in order to vary the overall configuration of the structure formed by assembling the panels.

2. Description of the Prior Art

Various patents have been granted relating to domed structures constructed from a plurality of panels in which the rigidity of the panels provides support for the domed structure rather than a separate framework being provided for the support of the structure. Prior U.S. Pat. No. 3,881,284, issued May 6, 1975, in which I am an assignee, discloses a structure of this type with the arrangements disclosed in this application generally constituting improvements over the structure disclosed in that patent.

Additionally, U.S. Pat. No. 4,160,345, issued July 10, 1979, discloses a domed structure in which the structural panels are distorted. Thus, while the prior patents disclose various types of domed structures, they fail to disclose the specific panel arrangements disclosed in this application which arrangements can be changed or expanded to vary the shape and size of the domed structure.

SUMMARY OF THE INVENTION

An object of the present invention is to provide a domed structure constructed of a plurality of flat, polygonal panels with each panel having a peripheral flange oriented in predetermined angular relation to the flat panel or surface of the panel with the flanges being secured together by any suitable means and with the panels being shaped and arranged in such a manner to provide a domed structure of pyramidal, triangular or square configuration.

Another object of the invention is to provide a domed structure in which expansion panels are provided between basic sections containing pentagonal and hexagonal panels to enable expansion of the domed structure to desired shapes and configurations.

Still another object of the invention is to provide a domed structure in accordance with the preceding objects in which the expansion panels are made in three pieces in order to incorporate an angle required to replace the number of panels from the dome with the length of the expansion panels giving the dome a triangular or pyramidal shape with rounded corners or a substantial square shape with rounded corners.

Yet another important object of the invention is to provide a domed building in which the overall shape is generally triangular with the apex panel being generally a true triangular panel or providing generally a square domed panel in which the apex panel is substantially a square panel.

A still further object of the invention is to provide a domed structure incorporating a plurality of panels or modules each of which is preferably of one-piece construction and may be constructed of glass fiber reinforced resinous plastic material with the panels or modules being assembled in a predetermined sequence and secured together in a conventional manner to facilitate rapid and efficient assembly of the domed structure and to provide a hollow enclosure which is inexpensive to manufacture, assemble and maintain.

These together with other objects and advantages which will become subsequently apparent reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

FIG. 1 is a partial perspective view of a triangular or pyramidal domed structure.

FIG. 2 is a detailed sectional view, on an enlarged scale, illustrating the angular relationship between the flat surface of the panel and the peripheral flange thereon.

FIGS. 3–9 are plan views of individual panels which are pentagonal, hexagonal or generally triangular.

FIG. 16 is a fragmentary perspective view of a portion of a square domed structure.

FIG. 17 is a sectional view, similar to FIG. 2, illustrating the angular relation of the flange on the panel to the flat surface of the panel.

FIGS. 18–23 are plan views of individual panels which are pentagonal, hexagonal or substantially square.

FIG. 33 is a group perspective view illustrating various arrangements in which the shape of the domed structure can be varied by varying the length of the expansion panels.

DESCRIPTION OF THE PREFERRED EMBODIMENTS

Figure 10:
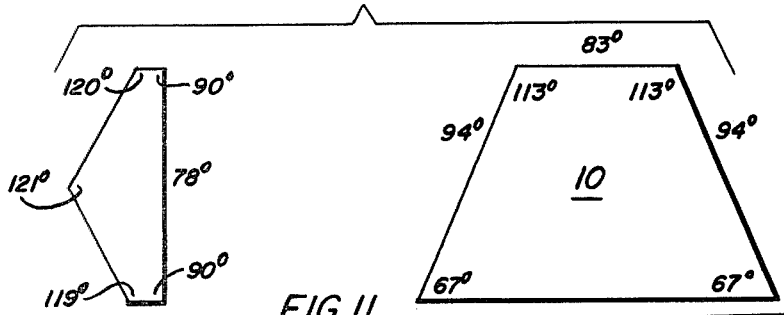
FIGS. 10–15 are group plan views of the expansion panels and one of the end panels associated with the expansion panels with the opposite end of each expansion panel including an identical end panel (not shown).
Figure 11:
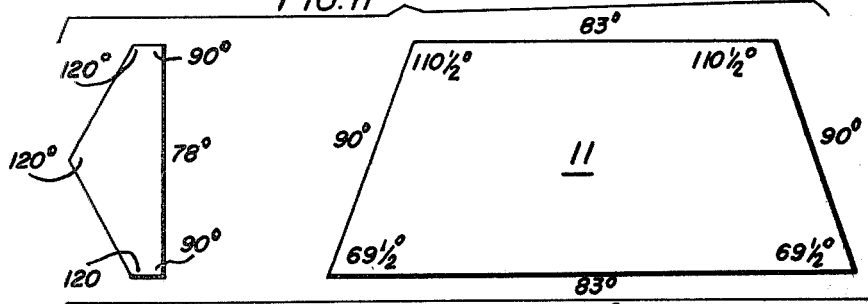
Figure 12:
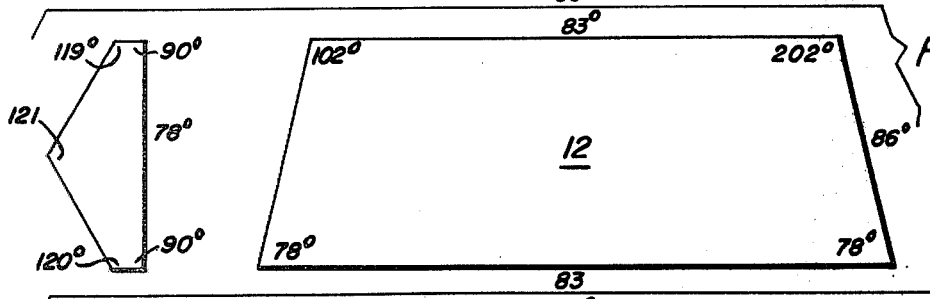
Figure 13:
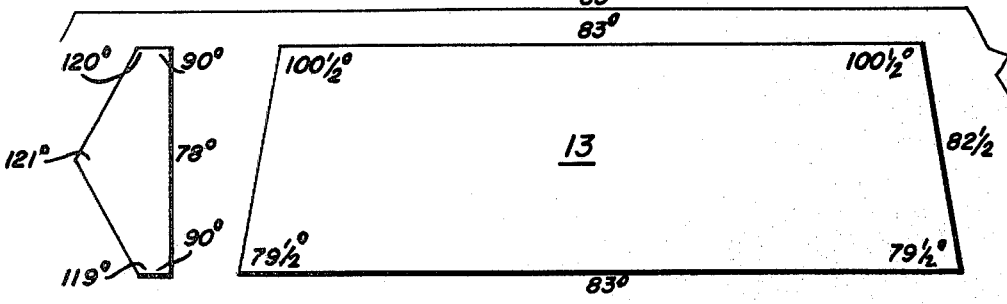
Figure 14:
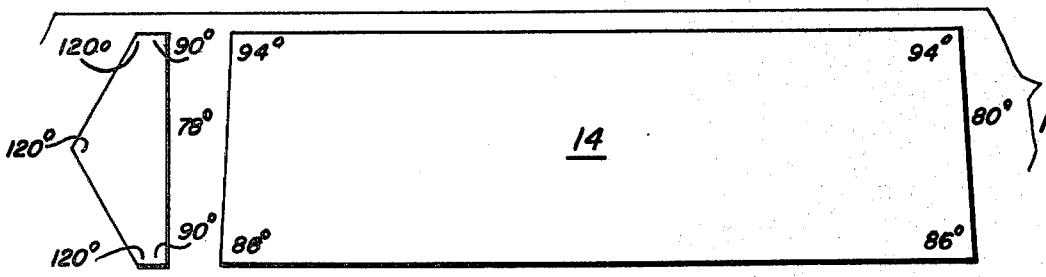
Figure 15:
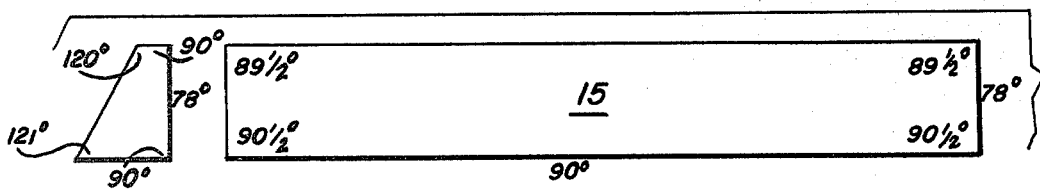

Referring now specifically to the drawings, the domed structure illustrated in FIGS. 1–15 of the drawings is generally designated by reference numeral 40 and is in the form of a generally triangular or pyramidal dome which includes three basic sections and two expandable sections with the edges thereof being pulled together to provide a tapering effect toward the apex of the dome.

As illustrated in FIG. 2, the various panels include a substantially rigid, flat member 42 and a peripheral flange 44 integral therewith and oriented in a particular angular relationship to the member 42 with the included angle between the member 42 and the flange 44 in FIG. 2 being 83°. The panels illustrated in FIGS. 3–9 are identified by the same numeral as identifies the particular Figure of the drawings and the included angle between adjacent edges of the main body member of each panel is indicated by being placed directly on the panel or adjacent thereto. For example, the pentagonal panel illustrated in FIG. 3 has reference numeral 3 applied thereto and each of the included angles between adjacent edges is 108°. In all of the panels illustrated in FIGS. 3–9, the included angle between the main body member and the peripheral flange will be 83° as illustrated in FIG. 2. Also, the panels may be constructed of glass fiber reinforced resin and may be secured together by suitable fasteners such as bolts, rivets or the like, extending through aligned apertures or the flanges on adjacent panels may be secured together by bonding material or the like. Also, the panels may be constructed of a peripheral frame which includes the flange and the main body may be an inserted transparent panel of either flexible or rigid characteristics or it may be a flexible or rigid translucent or opaque member. Also, it is pointed out that the hexagonal panel illustrated in FIG. 6 is a regular hexagon in which all of the included angles are equal whereas the other hexagonal panels have different included angles and the pentagonal panel illustrated in FIG. 8 also includes different included angles and the generally triangular panel 9 has its corners truncated.

The panels illustrated in FIGS. 10–15 are the expansion panels which are trapezoidal and each end of each expansion panel is provided with an end panel with each end panel on a particular expansion panel being of identical construction. Here again, the expansion panels are given the same identifying reference numeral as the Figure and the end panel attached to a corresponding expansion panel will be given the same reference numeral which is primed. For example, the expansion panel illustrated in FIG. 10 is identified by the numeral 10 with the end being designated by numeral 10'. Also, the included angle between the adjacent edges of the expansion panels 10–15 and the end panels 10'–15' are indicated on the interior of the outline of the respective panels or adjacent the included angle whereas the included angle between the main body member of the particular panels and the flange integral therewith is designated by the numeral exteriorly of the edge of the respective panel with the angle of the flange being located centrally of the length of the edge of the panel or connected thereto by a lead line. For example, in FIG. 10, the angle between the flange along the upper edge of the panel 10 and the main body member of the panel 10 is 83° whereas the angle between the flange along the side edges of the panel 10 and the main body member of the panel 10 is 94°.

The dome 40 is based upon the basic 5-sided dome such as that illustrated in the aforementioned U.S. Pat. No. 3,881,284, in which two basic sections have been removed and two expandable sections have been used. When this is done, the remaining space is closed by pulling the dome together with the expandable sections forming a tapering effect as the panels go together toward the apex of the dome. As illustrated, the expansion panels illustrated in FIGS. 10–15 are constructed of three pieces which is necessary to incorporate the angle required to replace the removed panels of the basic section, thus, in effect, replacing the number of degrees lost by removing the basic sections as noted above. The length of the expandable sections provide the dome structure with a generally triangle shape with rounded corners with the apex panel thus being almost a true triangular panel as illustrated in FIG. 9. This dome is expandable by lengthening the expansion sections a predetermined dimension which is incorporated from the lower panels toward the apex of the dome with the change in dimension being held the same from the lower panel to the apex panel when the dome is enlarged with the apex panel being equally enlarged.

Figures 24, 25, 26, 27, 28, 29, 30, 31, 32:
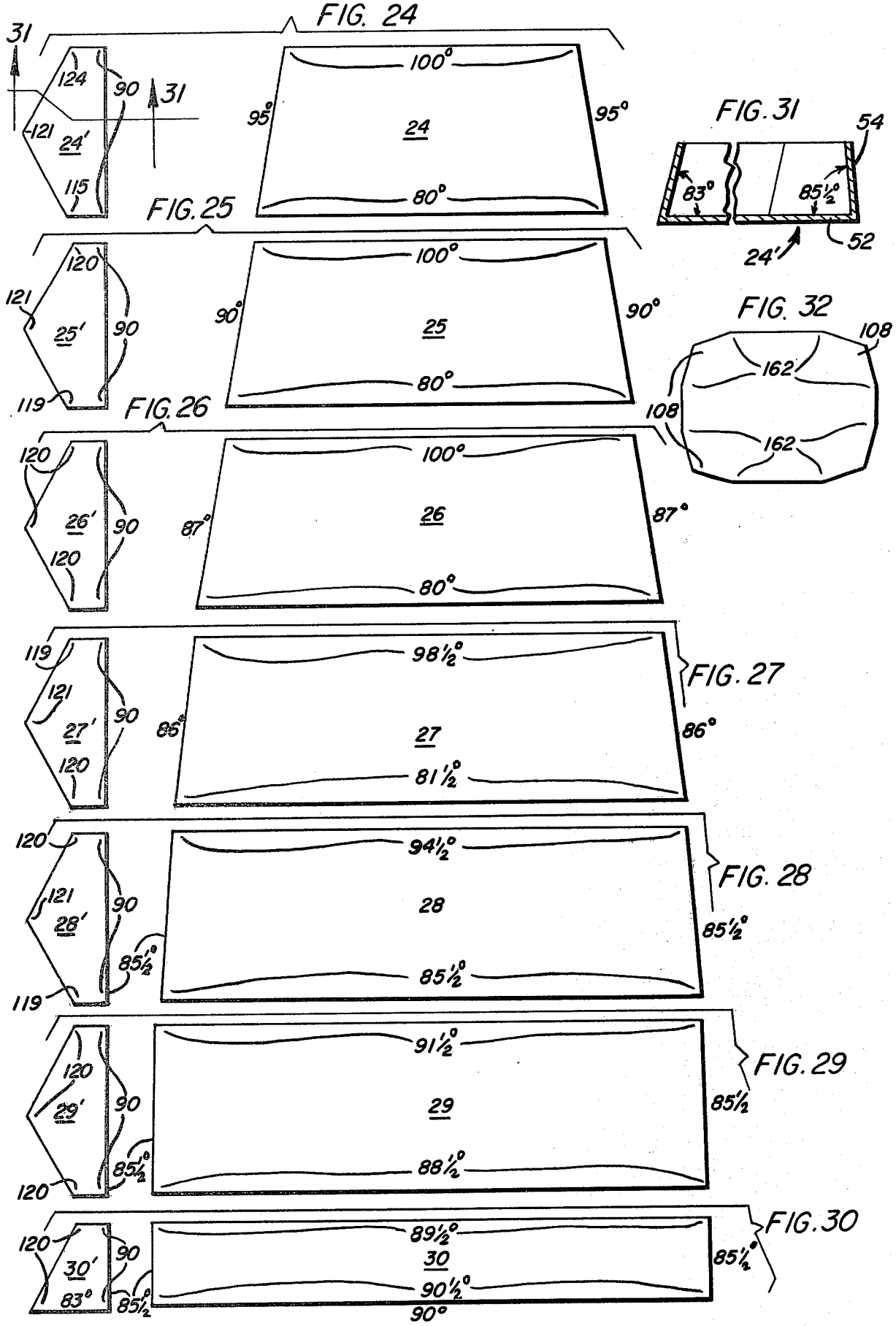
FIGS. 24–30 are plan views of expansion panels and one of the two end panels associated with each expansion panel utilized in the generally square domed structure.
FIG. 31 is a sectional view of the end panel illustrated in FIG. 24 taken substantially upon a plane passing along section line 31—31.
FIG. 32 is a plan view of a apex panel similar to FIG. 23 but being elongated into generally rectangular configuration rather than square configuration.

The domed structure illustrated in FIGS. 16–32 is designated by the numeral 50 and is generally of square configuration with the structures of the panels being generally the same as in FIGS. 1–15 with the main body member 52 and the peripheral flange 54 integral therewith being oriented with an included angle of 83° with all of the flanges in the panels illustrated in FIGS. 18–23 having all of the flanges oriented in the same manner, that is with an included angle of 83° with the main body member. The included angles between adjacent edges of the panels are disposed interiorly of the outline of the panels or adjacent thereto and the expansion panels illustrated in FIGS. 24–31 are likewise indicated with the included angle oriented interiorly of the corner involved and the angle of the flange being located at the center of the edge to which the respective flange is connected or connected thereto by a lead line. As illustrated, all of the top and bottom flanges on the expansion panels 24–30 and the end panels 24'–30' are 83° except for the bottom of the lowermost panel 30 which is 90°. These panels are constructed in the same manner as the panels illustrated in FIGS. 1–15 with the apex panel 23 being generally rectangular or square in configuration. This dome is based upon the basic 5 basic section dome with one basic section being removed and an expandable section replaces the basic section and the remaining hole or space is closed by pulling the dome together with the expandable section forming a tapering effect as the panels go together toward the apex of the dome. The expansion panels are made in three pieces and serve the same purpose as in FIGS. 1–15 with the length of the expandable sections giving the dome a generally square shape with rounded corners with the apex panel thus being almost a true square panel. The dome is also expandable by lengthening the expansion section a set dimension with this lengthening being constant throughout the vertical arrangement of the panels with FIG. 32 illustrating an elongated apex panel and FIG. 33 illustrating elongation of the expandable sections to vary the dimensional characteristics of the domed structure with the elongated expansion panels being designated by double primed numbers.

As illustrated in the various drawings, the shape of the domed structure may be varied by substituting expansion panels of different lengths and by varying the number of basic sections which are formed by the pentagonal panel and the hexagonal panels associated therewith which are oriented between the expansion sections constituted by a plurality of expansion panels including the central panel and the two end panels. The apex panels generally conform with the overall plan of the domed structure.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A domed structure comprising a plurality of rigid, polygonal panels secured together about their peripheral edges to define a hollow enclosure, said panels being flat and provided with laterally extending edge flanges throughout the periphery of each panel, said flanges projecting inwardly of the domed structure and being flat and continuous with the edges of the polygonal panels, said panels being arranged in basic sections and expansion sections with all of the panels in the basic sections being pentagonal and hexagonal with all of the flanges on the panels in the basic section having an included angle with the panel of 83°, the expansion section panels being constructed of a plurality of trapezoidal panels with parallel top and bottom flanges and upwardly converging end flanges, an end panel connected to each of the upwardly converging end flanges of each of the trapezoidal panels, the edge of each end panel remote from the trapezoidal panel to which it is attached being provided with an angular orientation to interfit with the panels in an adjacent basic section to provide a continuous peripheral wall, the included angle between the end flanges and the panel of the trapezoidal panels increasing from less than 90° at the lowermost trapezoidal panel to greater than 90° at the uppermost trapezoidal panel to provide a tapering arrangement for the domed structure with the number of basic sections and expansion sections being selected to provide a desired shape to the domed structure, and an apex panel of generally the same plan configuration as the plan configuration of the domed structure.

2. The structure as defined in claim 1 wherein each of said panels is constructed of glass fiber reinforced plastic mateial and the lower edge of the domed structure is provided with filler panels to provide a substantially horizontal edge to the structure.

3. The structure as defined in claim 1 wherein the angle between the upwardly converging end edges of each trapezoidal panel and the bottom edge of the trapezoidal panel decreases from the lowermost trapezoidal panel to the uppermost trapezoidal panel while the included angle between the upwardly converging end edges of each trapezoidal panel and the top edge thereof increases from the lower trapezoidal panels toward the upper trapezoidal panels.

* * * * *